US006129529A

United States Patent [19]

Young et al.

[11] Patent Number: 6,129,529

[45] Date of Patent: Oct. 10, 2000

[54] LIQUID PETROLEUM GAS SUBMERSIBLE ELECTRIC MOTOR DRIVEN PUMP AND DRIVE COUPLING THEREFOR

[75] Inventors: David Sterling Young, Maquoketa, Iowa; Dale Ewing, Milan, Ill.

[73] Assignee: Marley Pump, Davenport, Iowa

[21] Appl. No.: 09/161,655

[22] Filed: Sep. 29, 1998

[51] Int. Cl.[7] ..... F04B 17/00; F04B 35/04

[52] U.S. Cl. ..... 417/423.3; 417/423.6; 417/423.14

[58] Field of Search ..... 417/423.3, 423.6, 417/423.14, 366, 422

[56] References Cited

U.S. PATENT DOCUMENTS

| | | | |
|---|---|---|---|
| 2,277,333 | 3/1942 | Leopold | 417/423.11 |
| 2,455,022 | 11/1948 | Schmidt | 417/99 |
| 2,510,414 | 6/1950 | Philbrick | 417/423.3 |
| 2,844,100 | 7/1958 | Heinicke | 417/423.3 |
| 2,930,325 | 3/1960 | Beard et al. | 417/423.15 |
| 3,118,385 | 1/1964 | Yates | 417/423.14 |
| 3,214,149 | 10/1965 | Budzien | 261/29 |
| 3,588,154 | 6/1971 | Voight et al. | 287/108 |
| 4,115,038 | 9/1978 | Litzenberg | 417/357 |
| 4,281,973 | 8/1981 | Meneghello | 417/424 |
| 5,013,221 | 5/1991 | Tuckey | 417/365 |
| 5,131,822 | 7/1992 | Yamamoto et al. | 417/423.7 |
| 5,173,037 | 12/1992 | Martin et al. | 417/423.3 |
| 5,336,064 | 8/1994 | Lamers | 417/423.3 |
| 5,659,214 | 8/1997 | Guardiani et al. | 310/87 |
| 5,688,067 | 11/1997 | Straub | 403/305 |

FOREIGN PATENT DOCUMENTS

| | | |
|---|---|---|
| 2485647 | 12/1981 | France . |
| 398193 | 2/1966 | Switzerland . |
| 772654 | 4/1957 | United Kingdom . |

*Primary Examiner*—Henry C. Yuen
*Assistant Examiner*—Mahmoud N Gimie
*Attorney, Agent, or Firm*—Sughrue, Mion, Zinn, Macpeak & Seas, PLLC

[57] ABSTRACT

A submersible electric motor driven pump includes a motor assembly having an elongated tubular motor housing, an electric motor disposed in the motor housing, and a rotary motor shaft having an output end which extends from the electric motor; and a pump assembly including an elongated tubular pump housing, a driven pump shaft having external spline teeth at an end thereof, and at least one centrifugal impeller disposed on the pump shaft. A drive coupling is fixed to the output end of the motor shaft and has internal spline teeth which are slidably engaged with the external spline teeth of the pump shaft. The drive coupling transmits rotational power from the electric motor to the pump shaft, with the end of the pump shaft being operative to float axially within the drive coupling. A flanged interface surrounds the drive coupling and rigidly joins the motor assembly and the pump assembly together coaxially end to end in a sealed manner.

18 Claims, 10 Drawing Sheets

LIQUID PETROLEUM GAS SUBMERSIBLE ELECTRIC MOTOR DRIVEN PUMP AND DRIVE COUPLING THEREFOR

BACKGROUND OF THE INVENTION

1. Field of the Invention

The present invention relates to a submersible motor driven pump and, in particular, a liquid petroleum gas (LPG) submersible electric motor driven pump and drive coupling therefor.

2. Description of the Related Art

As the demand for LPG fuel from fleet, government and private usage increases, there has been a simultaneous need in the field for a greater pressure and performance from the LPG pumping system. Moreover, in the conventional LPG systems which utilize suction pumps, vapor lock is a persistent problem and occurs when fuel is pulled beyond its vaporization point, thereby reducing the vacuum necessary to pull the fuel from the storage tank. Moreover, larger tanks and longer pipe runs, which are necessary to meet the increasing fuel demands, only aggravate the problem.

Accordingly, there is a need in the LPG pumping industry to provide a submersible pump which is operative to push the fuel from the tank, thereby effectively moving any existing vapor in the lines to the vapor recovery system. Such a submersible pump would maintain serviceability while staying clear of customers and the forces of nature, making them safer and less obtrusive than external pumps.

SUMMARY OF THE INVENTION

It is an object of the present invention to provide a liquid petroleum gas submersible electric motor driven pump and drive coupling therefor which meets the need for greater pressure and performance in the LPG pumping industry, and which is operative to effectively move any existing vapor in the lines to the vapor recovery system.

It is a further object of the present invention to provide an explosion-proof LPG submersible electric motor driven pump wherein the pump and motor are designed as separate, contained entities which are joined together by a flanged interface which allows easy pump and motor installation including the possibility of interchanging different pumps to a single motor while at the same time conforming with regulatory requirements.

It is yet another object of the present invention to provide a drive coupling for transmitting rotational power from the drive motor to the pump in the form of a gear tooth spline which permits the pump shaft to float axially until it contacts the motor shaft end face, such that pumps having different shaft lengths can be mounted to the same motor provided there is ample clearance between the pump and motor shafts.

It is yet a further object of the present invention to provide an explosion-proof LPG submersible electric motor driven pump which is designed to pump liquified petroleum gas in its liquid state. Preferably, the pump is in the form of a multi-stage centrifugal pump which is able to pump butane, propane, or any mixture of the two.

In particular, the submersible electric motor driven pump comprises a motor assembly including an elongated tubular motor housing, an electric motor disposed in the motor housing, and a rotary motor shaft having an output end which extends from the electric motor; and a pump assembly including an elongated tubular pump housing, a driven pump shaft having an input end facing the motor shaft, and at least one centrifugal impeller disposed on the pump shaft.

A drive coupling is fixed to the end of one of the motor shaft and the pump shaft and has internal spline teeth which are slidably engaged with external spline teeth of the other of the motor shaft and the pump shaft. The drive coupling transmits rotational power from the electric motor to the pump shaft, with the end of the pump shaft being operative to float axially with respect to the motor shaft. An interface surrounds the drive coupling and rigidly joins the motor assembly and the pump assembly together coaxially end to end in a sealed manner.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

Figure 1:
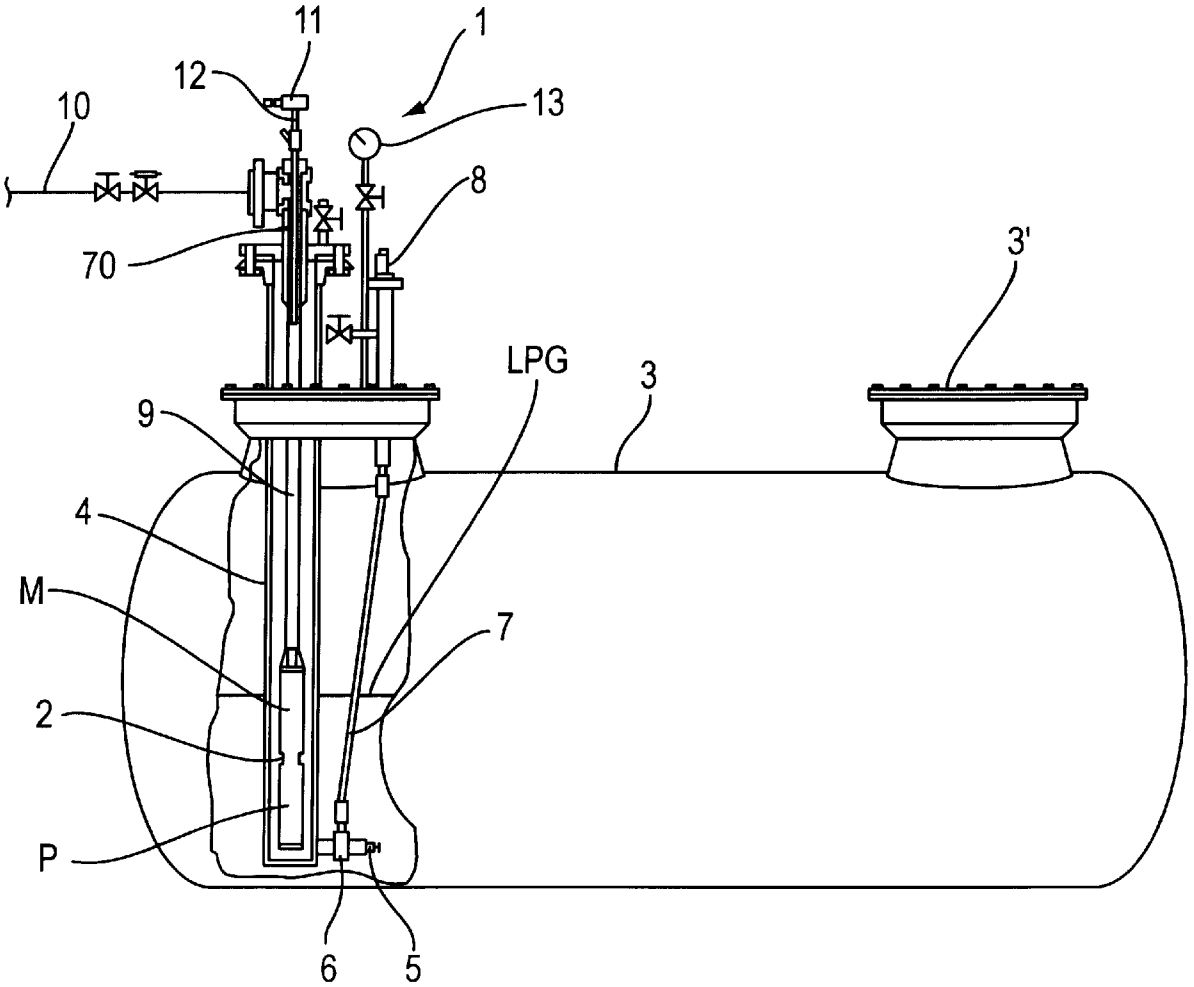
FIG. 1 is a schematic illustration of an LPG dispensing installation including the LPG submersible electric motor driven pump according to the present invention.

The present invention will now be described with reference to the drawings. FIG. 1 illustrates an LPG dispensing installation 1 including the LPG submersible electric motor driven pump 2 according to the present invention. The LPG dispensing installation 1 includes a pressure vessel 3 for holding petroleum gas, e.g., butane, propane or any mixture of the two, in its liquid state. The LPG submersible electric motor driven pump 2 extends down within a pump manifold or service chamber 4, both the LPG submersible electric motor driven pump 2 and the pump manifold 4 being suspended from a top portion of the pressure vessel 3. The pump manifold 4 can be drained to permit servicing of the LPG submersible electric motor driven pump 2 and thereby avoid having to drain the entire pressure vessel 3. The pressure vessel 3 includes a sealed access opening 3' for mounting an additional LPG dispensing installation if desired.

An overflow valve 5 and a shut off valve 6, which is operated by a shut off mechanism 7, are positioned at the bottom of the pump manifold 4. A closing device 8 for the shut off valve 6 is provided externally of the pressure vessel 3. The pump manifold 4 and a discharge pipe 9 of the submersible electric motor driven pump 2 extend externally beyond the pressure vessel 3. A discharge line 10 for the liquified LPG gas which has been pumped out of the pressure vessel 3 by the submersible electric motor driven pump 2 is connected to the discharge pipe 9 of the pump 2. An electrical junction box 11 is disposed above the external portion of the discharge pipe 9 of the pump 2. Electrical wires 12, which carry electrical power to the electric motor of the submersible pump, extend down from the box 11. The discharge line 10 is connected to an LPG dispensing metering system (not shown), the particulars of which are known in the art. A tank pressure gauge 13 is provided for measuring the pressure in the pressure vessel 3.

FIGS. 2–9 show the details of the LPG submersible electric motor driven pump 2 and drive coupling therefor according to one embodiment of the present invention. The pump 2 is an explosion-proof submersible electric motor driven pump, designed to pump liquified petroleum gas in its liquid state. The LPG submersible electric motor driven pump 2 is able to pump butane, propane or any mixture of the two. The pump per se is preferably a multi-stage centrifugal pump assembly P which includes, preferably but not necessarily, twenty-four stages. For the sake of brevity, only some of the multiple stages are shown in the drawings. The particulars of the multi-stage centrifugal pump assembly P will be discussed in more detail below.

The submersible pump P is driven by an electric motor which is preferably a submersible polyphase motor 41. The submersible electric motor 41 is designed so that the liquified petroleum gas being pumped is passed through the motor assembly M to cool and lubricate the motor assembly M. Again, the details of the motor assembly M will be discussed below.

Figure 2:
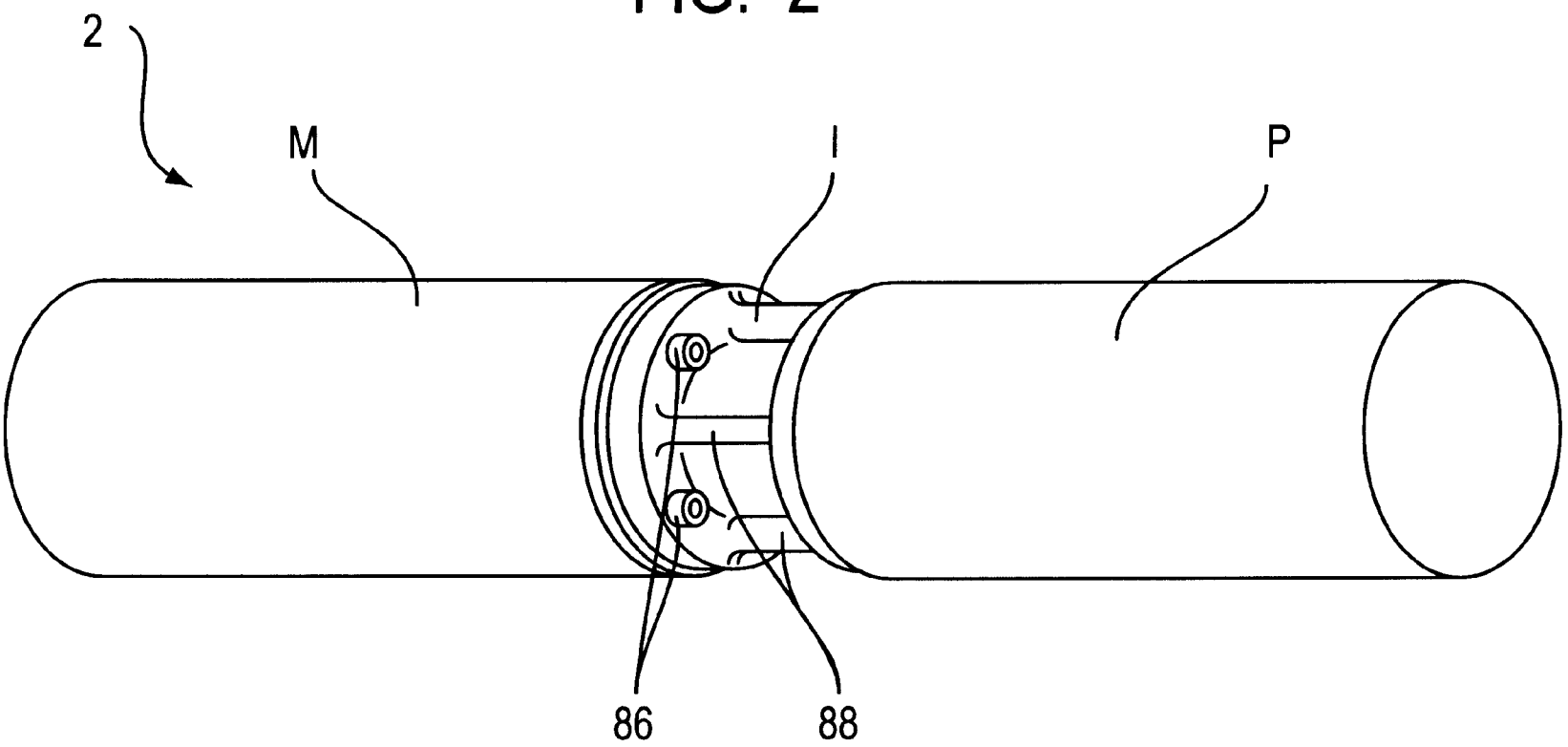
FIG. 2 is a simple schematic perspective view of the submersible electric motor driven pump according to the present invention.
Figure 3:
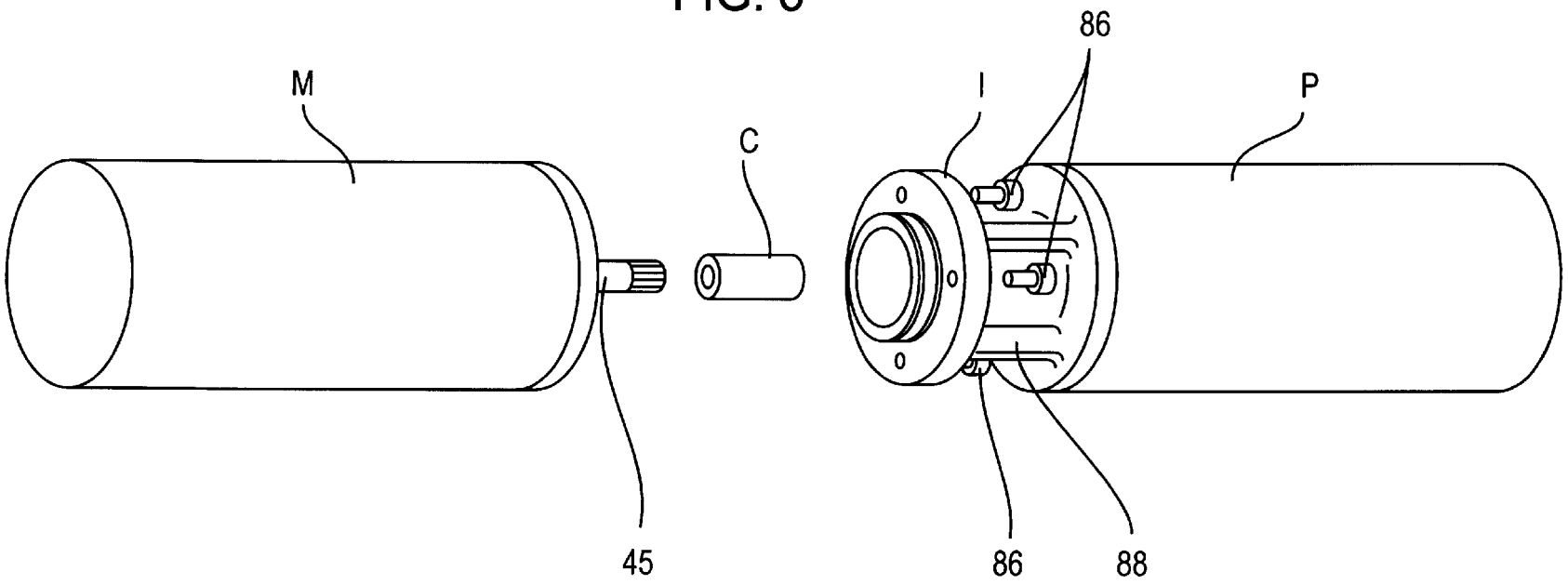
FIG. 3 is a simple schematic exploded perspective view of the submersible electric motor driven pump according to the present invention, with a view toward the pump assembly side.
Figure 4:
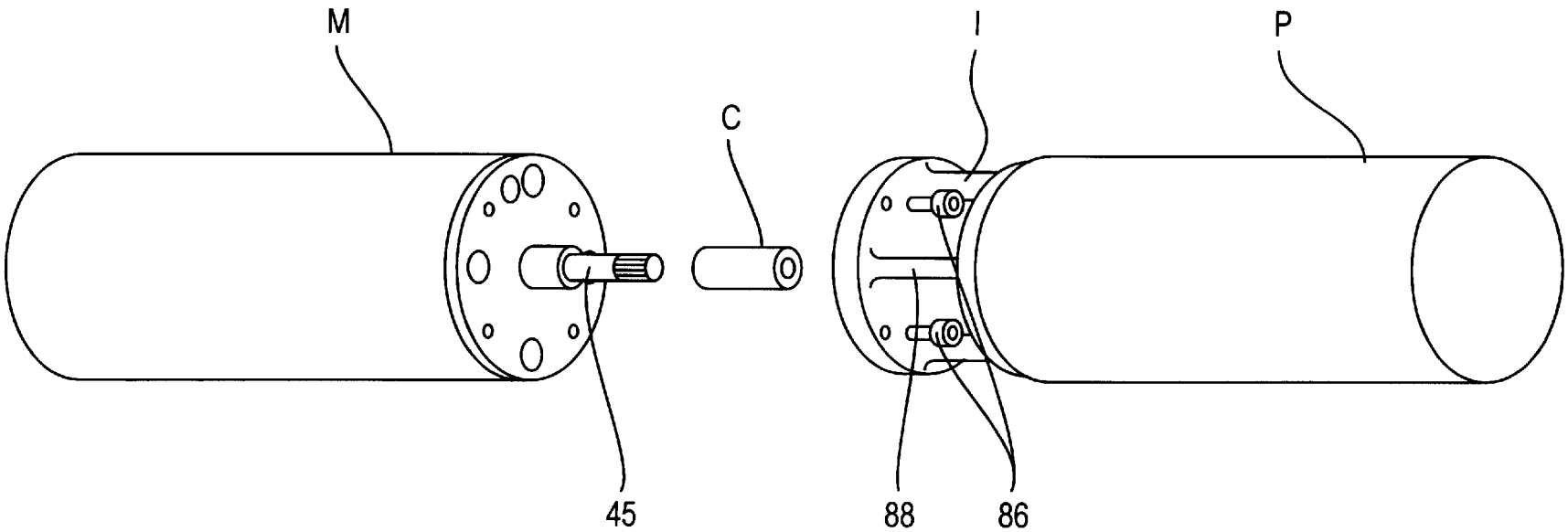
FIG. 4 is a simple schematic exploded perspective view of the submersible electric motor driven pump according to the present invention, with a view toward the motor assembly side.
Figure 5:
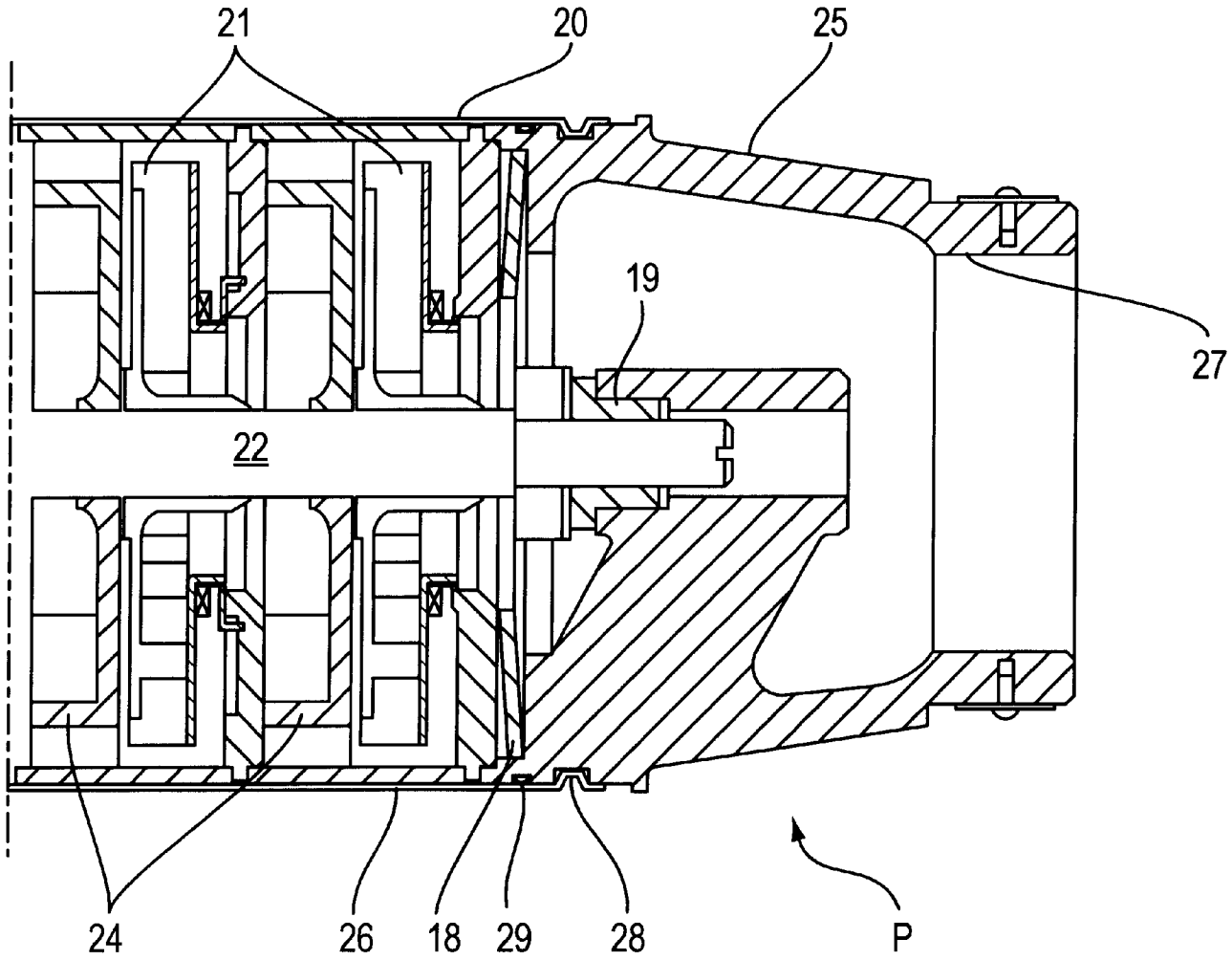
FIG. 5 is a fragmentary cross-sectional view through the submersible electric motor driven pump according to the present invention and focusing on the inlet side of the pump assembly.
Figure 6:
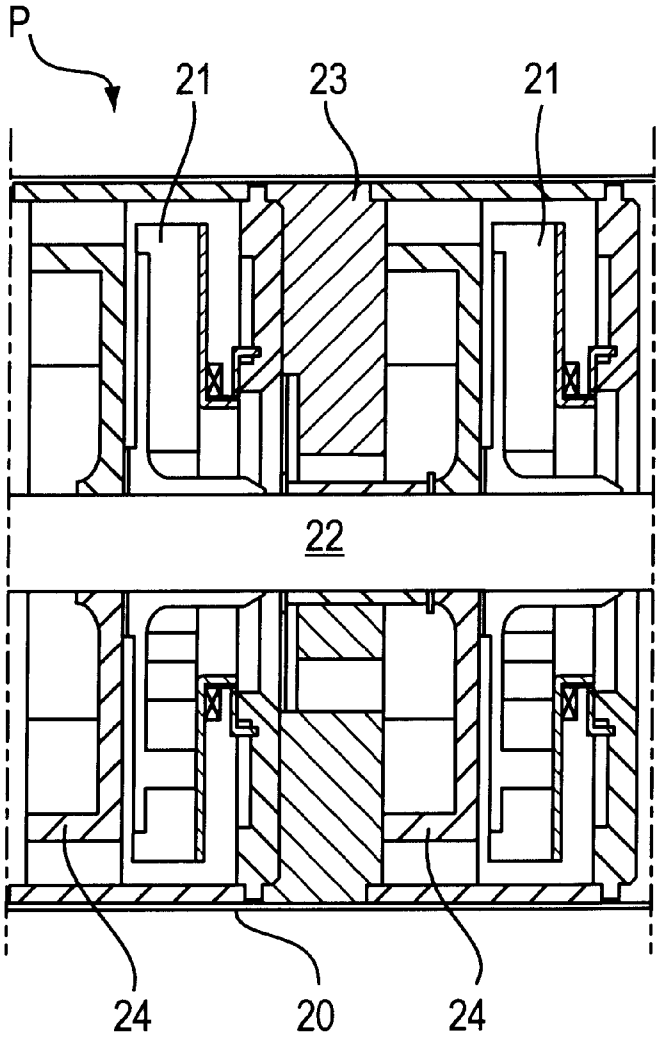
FIG. 6 is a fragmentary cross-sectional view through the submersible electric motor driven pump according to the present invention and focusing on an intermediate portion of the pump assembly.

As shown schematically in FIGS. 2–4, the pump assembly P and the motor assembly M are designed as separate, contained entities which adhere to the explosion-proof petroleum submersible pump design characteristics for hazardous locations, as required by international and national regulatory agencies. The pump assembly P and the motor assembly M are joined together by a flanged interface I. The details of the flanged interface I will be discussed in more detail below. At this juncture, it is noted that the fact that the pump assembly P and motor assembly M are separate, contained entities joined together by the flanged interface I allows not only easy pump and motor installation thereby lowering maintenance costs, but also allows different pumps to be interchanged to a single motor easily while conforming to regulatory requirements in the LPG pumping industry.

As shown schematically in FIGS. 3 and 4, a gear tooth spline drive coupling C is provided for transmitting rotational power from the motor to the pump and permits the pump shaft to float axially until it contacts the motor shaft end face. A detailed discussion of the drive coupling C is set forth below.

Turning to the construction of the pump assembly P per se (see especially FIGS. 5–7), the pump assembly P includes an elongated tubular or cylindrical pump housing or casing 20 which is in the form of a thin metal shell which is roll-formed into a gland (28 and 31) at each end of the pump assembly P. The thin metal shell is preferably formed of 304 stainless steel which is 0.023"–0.027" thick. The roll-forming is completed while compressing the entire pump assembly with an axial force. The roll-forming traps and stores the compressive force inside the assembled components. As noted above, the pump is preferably, but not necessarily, a multi-stage centrifugal pump having twenty-four stages. The centrifugal impellers 21 are mounted on a rotary pump shaft 22 which is journalled for rotation within the pump housing 20. Preferably, a bronze, intermediate shaft stabilizer 23 (see FIG. 6) dampens vibration. A like number of diffusers 24 are included within the pump housing 20 corresponding to the number of impellers 21. The impellers 21 and diffusers 24 are preferably molded of CELCON (acetel copolymer) and hydraulically balanced for quiet operation and long life. The above-noted compressive force applied during the roll-forming of the pump casing 20 serves to squeeze the centrifugal diffusers 24 axially so that they remain stationary. An inlet end cap 25 is provided at the lower end 26 of the pump housing 20 and includes an inlet opening 27 for the liquified petroleum gas. A pump shaft bearing 19 is disposed in the inlet end cap 25. A disc spring 18 is provided to bias the pump components. The lower end 26 of the tubular pump housing 20 is roll-formed into the gland 28 formed in the inlet end cap 25. An O-ring seal 29 is disposed between the pump housing 20 and the inlet end cap 25 just above the gland 28.

Figure 7:
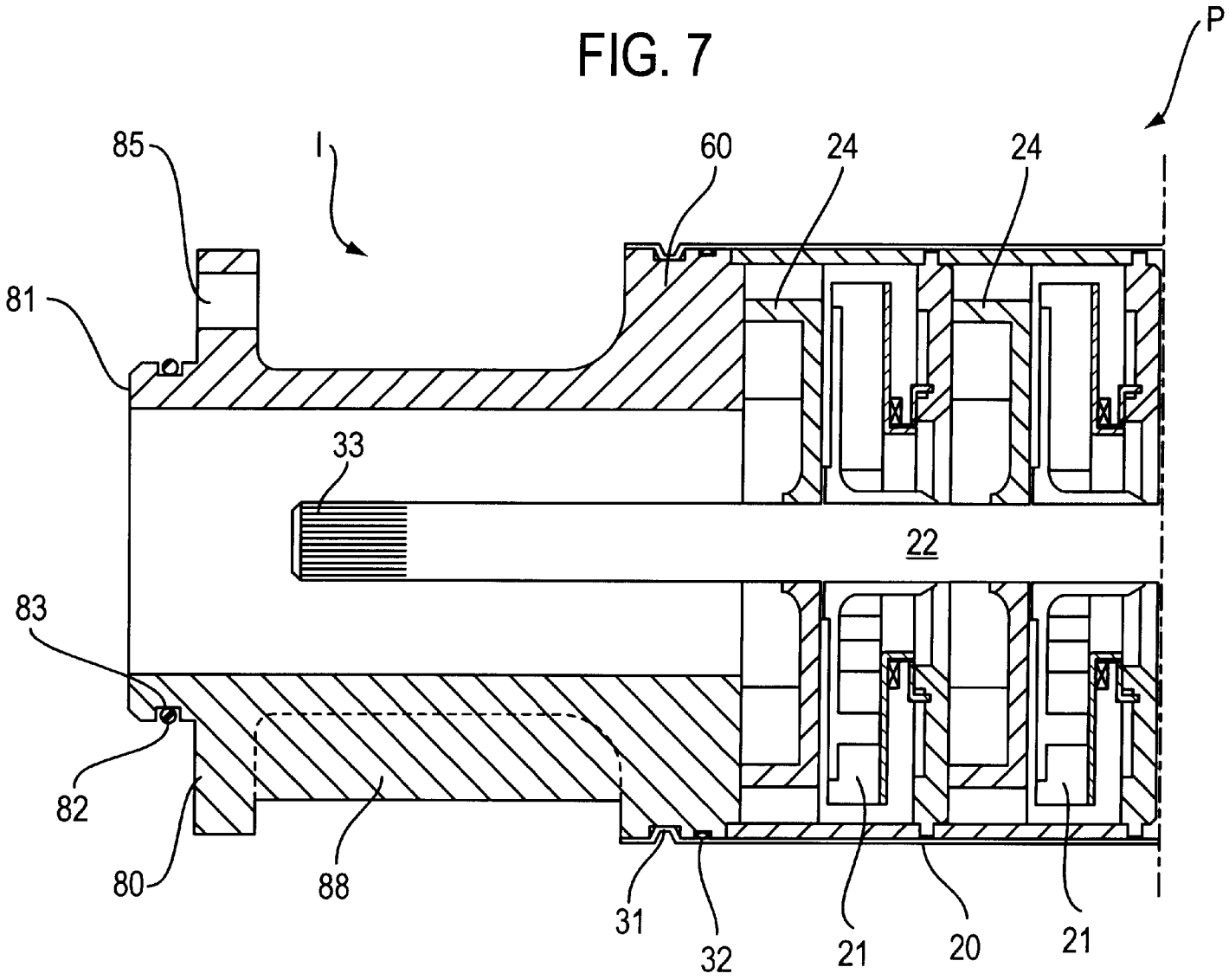
FIG. 7 is a fragmentary cross-sectional view through the submersible electric motor driven pump according to the present invention and focusing on the outlet end of the pump assembly and on the flanged interface.

As shown in FIG. 7, the upper end 30 of the tubular pump housing 20 is roll-formed into the gland 31 formed in a pump-facing flange 60 of the flanged interface I and includes an O-ring seal 32 to rigidly and sealingly retain the flanged interface I. The end of the pump shaft 22 facing toward the motor assembly M extends toward the motor assembly M within the flanged interface I and is formed with external spline teeth 33 operative to be received within the drive coupling C as will be discussed in more detail below.

Figure 8:
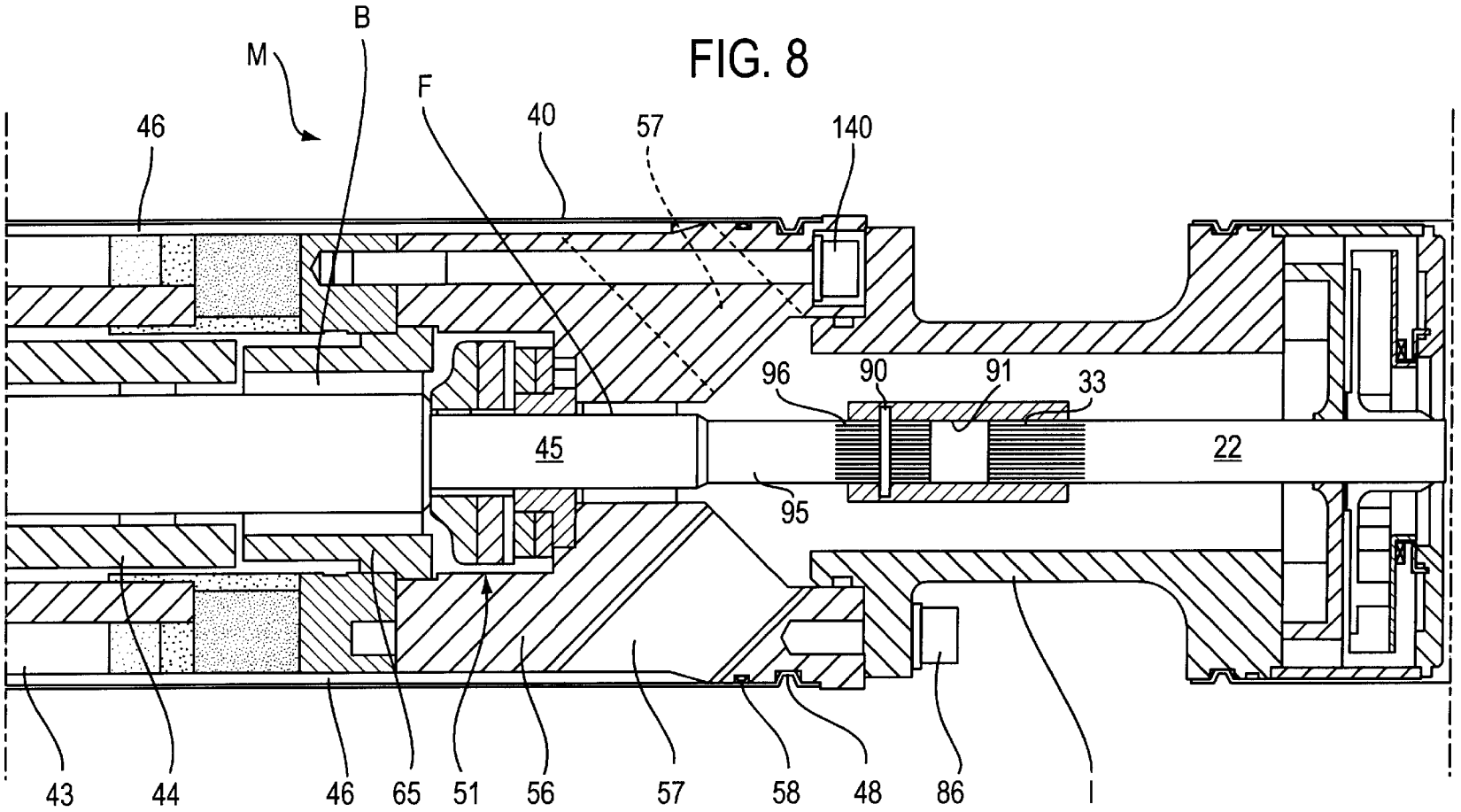
FIG. 8 is a fragmentary cross-sectional view through the submersible electric motor driven pump according to the present invention and focusing on the lower end of the motor assembly mounted to the flanged interface.
Figure 9:
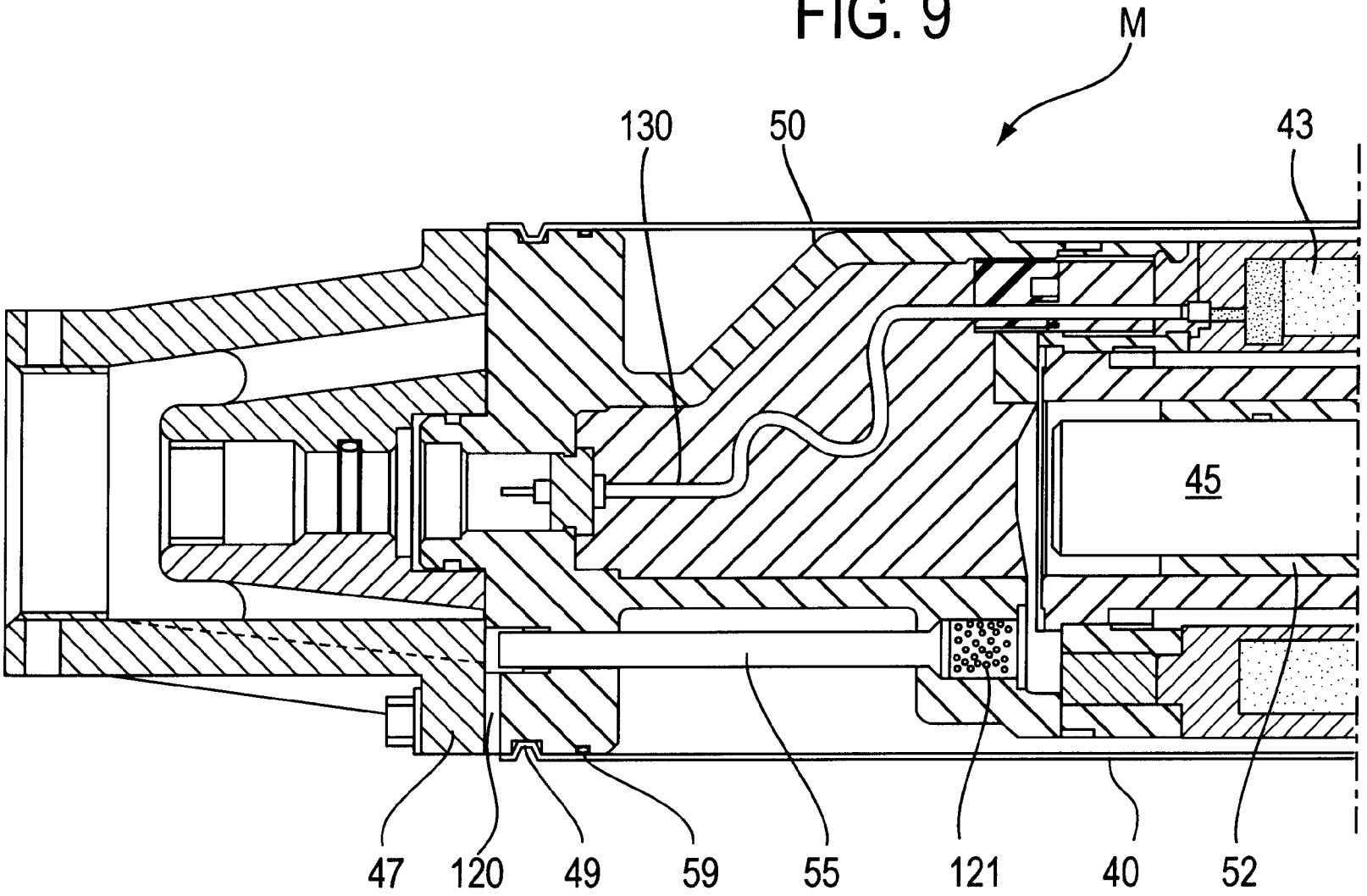
FIG. 9 is a fragmentary cross-sectional view through the submersible electric motor driven pump according to the present invention and focusing on the upper end of the motor assembly.

As shown in FIGS. 8 and 9, the motor assembly M likewise includes an elongated tubular or cylindrical motor housing or casing 40 that is formed of a thin metal shell (of like material and thickness as the pump housing 20) which is roll-formed into a gland 48 and 49 at each end of the motor assembly M. An O-ring 59 is disposed just below the gland 49 between the motor casing 40 and a motor receptacle 50 of the motor assembly M. Within the motor housing or casing 40, the submersible electric motor 41 includes a stator 43, and a rotor 44 which is rotatably supported by a motor shaft 45. The motor shaft 45 is preferably constructed of 416 stainless steel with electroless nickel plating.

During pumping of the liquified gas, after the liquified gas has passed through the pump assembly P and the flanged interface I, approximately 90% of the liquified gas passes through an annular chamber 46 passing between the motor stator 43 and the outer motor casing 40. After passing around the stator 43 upwardly to the top of the motor housing 40, the liquified gas passes out through a discharge end cap 47 which is bolted to the motor receptacle 50 of the motor assembly M. On the other hand, the remaining approximately 10% of the liquified gas passes through a small clearance between the motor shaft 45 and a bronze, non-sparking flame prevention member F positioned in a motor base assembly 56, between a thrust bearing 51 and the motor shaft 45, and between a carbon graphite bearing B and the motor shaft 45, so as to cool the same. The carbon graphite bearing B has a spiral groove (not shown) to enhance liquid flow, and is positioned within an iron housing 65. The liquified gas then moves upwardly in the clearance between the rotor 44 and the stator 43, the clearance between the motor shaft 45 and the upper shaft bearing 52 (which also includes a spiral groove), and then through a liquified gas bypass tube 55 which bypasses this portion of the liquified gas back into the pressure vessel 3 through a radial passage 120. The purpose of the liquified gas bypass 55 is to ensure that a portion of the liquified gas is always flowing through the motor to prevent the LPG gas within submersible electric motor driven pump 2 from overheating and vaporizing thereby causing a vapor lock in the pump. By providing the bypass 55, a small amount of liquified gas is always circulated through the pump and returned back to the pressure vessel 3. The bypass tube 55 is preceded by a filter 121.

Electric power is carried to the submersible electric drive motor 41 by the electrical wires 12 disposed in a conduit 70 which passes through the pump discharge pipe 9 in a concentric manner such that the liquified gas passing out of the discharge end cap 47 and up to the LPG dispensing system 1 surrounds the conduit 70 containing the electrical wires 12. The concentric conduit 70 is connected to the discharge end cap 47 and permits the electrical wiring 12 passing therethrough to be connected to corresponding electrical wiring 130 within the motor housing 40.

At the lower end of the motor assembly M, the motor shaft 45 is rotatably journalled in the bearing B held by the motor base assembly 56. The motor base assembly 56 is bolted by a plurality of bolts 140 (only one of which is in view in FIG. 8) to the electric drive motor 41. The motor base assembly 56 is formed with a plurality of angled channels 57 which communicate an open end of the motor base assembly 56 with the annular chamber 46 for passing liquified gas therethrough. The gland 48 is likewise formed in an outer circumference of the motor base assembly 56 and receives the roll-formed portion of the motor housing or casing 40, as described above. An O-ring seal 58 is positioned just above the gland 48 between the motor base assembly 56 and the motor casing 40.

The flanged interface I will now be discussed in more detail. In particular, an upper or motor-facing flange 80 of the flanged interface I is formed with a plurality of fastener-receiving holes 85. The motor-facing flange 80 of the flanged interface I is fixed with a plurality of fasteners, e.g., bolts 86, (see FIGS. 2–4 and 7) to the motor base assembly 56 of the motor assembly M. The flanged interface I also includes an inner annular extension portion 81 having an O-ring seal 82 positioned in an outer circumferential groove 83 thereby to form a seal between the flanged interface I and the motor base assembly 56. The flanged interface I is generally spool-shaped having a cylindrical intermediate portion 87 and the pump-facing flange 60 and the motor-facing flange 80. A plurality of reinforcing ribs 88 are formed around the outer circumference of the cylindrical intermediate portion 87 and extend axially between the two end flanges 60 and 80. As was pointed out in detail above, the tubular pump housing 20 is roll-formed into the gland 31 formed in pump-facing flange 60 of the flanged interface I. In this way, the flanged interface I surrounds the drive coupling C and rigidly joins the motor assembly M and the pump assembly P together coaxially end to end in a sealed manner.

The drive coupling C is preferably in the form of a hollow, cylindrical member having one end fixed to the output end 95 of the motor shaft 45, for example, by a fixing member such as a pin 90. The drive coupling C has internal spline teeth 91 which are operative to slidably engage with the external spline teeth 33 of the pump shaft 22. In addition to the pin 90, the drive coupling may be fully splined internally to also engage with corresponding external splines 96 formed on the output end 95 of motor shaft 45. By forming the drive coupling C as a gear tooth spline, the pump shaft 22 is able to float axially until it contacts the motor shaft 45 end face. In this way, pumps having different shaft lengths can be mounted to the same motor provided there is ample clearance between the pump and motor shafts.

Figure 10:
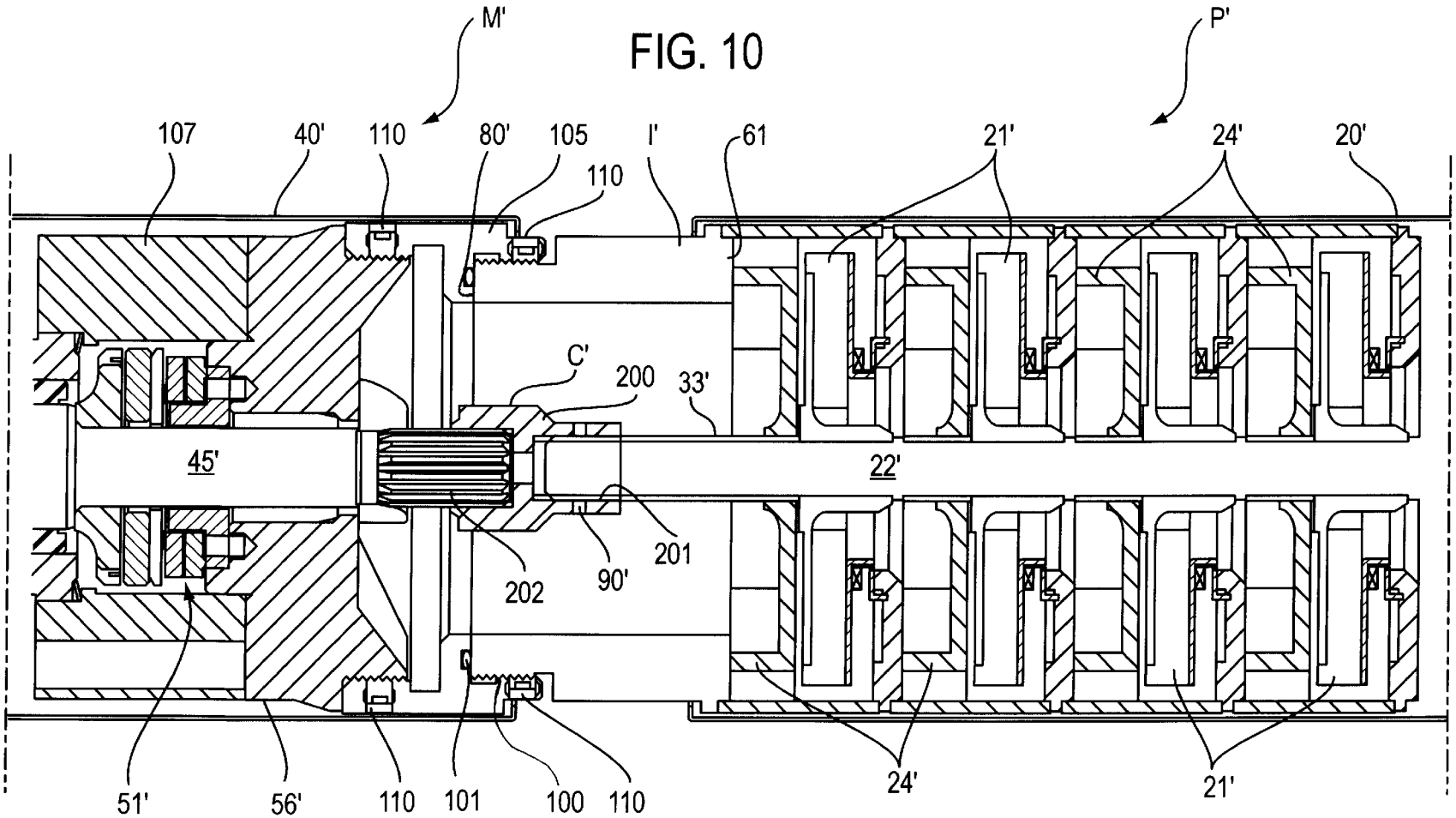
FIG. 10 is a fragmentary cross-sectional view through an alternative embodiment of the present invention wherein the interface is threaded into the motor assembly as opposed to being bolted.

While the above-noted embodiment uses a flanged interface I which is bolted to the motor assembly M, FIG. 10 shows an alternative arrangement. Note that like structural elements are denoted by like reference numerals followed by a prime sign (′). Instead of being bolted to the motor assembly M′, the interface member I′ is threadedly engaged at threaded joint 100 to an intermediate member 105 which in turn is threadedly engaged with the motor base assembly 56′ at threaded joint 106. Screws 110 are provided for locking the threaded connections. The motor base assembly 56′ is fixed to a spacer ring 107. Moreover, in this alternative embodiment, the ends of the pump housing 20′ and the motor housing 40′ are each crimped over. In the case of the pump housing 20′, the end is crimped over an annular flange at the pump-facing end 60′ of the interface member I′. In the case of the motor, the motor housing 40′ is crimped over a stepped portion of the motor base assembly 56′. A suitable O-ring seal 101 is positioned between a motor-facing end 80′ of the interface member I′ and the intermediate member 105.

In the alternative embodiment of FIG. 10, the drive coupling C′ also takes on a modified form wherein two separate shaft-receiving bores 201 and 202 which are internally splined are formed in a cylindrical member 200 for respectively receiving the splined ends of the pump shaft 22′ and the motor shaft 45′. In this case, the coupling C′ may be pinned at 90′ to the end of the pump shaft 22′.

It is contemplated that numerous modifications may be made to the LPG submersible electric motor driven pump and drive coupling therefor of the present invention without departing from the spirit and scope of the invention as defined in the following claims.

What is claimed is:

1. A submersible electric motor driven pump comprising:

a motor assembly including an elongated tubular motor housing, an electric motor disposed in said motor housing, and a rotary motor shaft having an output end which extends from said electric motor;

a pump assembly including an elongated tubular pump housing, a driven pump shaft having an input end facing said motor shaft, and at least one centrifugal impeller disposed on said pump shaft;

a drive coupling fixed by a fixing member to the end of one of said motor shaft and said pump shaft and having internal spline teeth which are slidably engaged with external spline teeth of the other of said motor shaft and said pump shaft and for transmitting rotational power from said electric motor to said pump shaft, the end of said pump shaft being operative to float axially with respect to said motor shaft; and an interface surrounding said drive coupling and which rigidly joins said motor assembly and said pump assembly together coaxially end to end in a sealed manner.

2. The submersible electric motor driven pump according to claim 1, wherein said interface is generally spool-shaped and includes a cylindrical intermediate portion, a pump-facing flange and a motor-facing flange, said motor-facing flange having a plurality of fastener-receiving holes and said interface being fixed with a plurality of fasteners to said motor assembly.

3. The submersible electric motor driven pump according to claim 1, wherein said interface is threadedly engaged with said motor assembly.

4. The submersible electric motor driven pump according to claim 2, wherein said interface includes a plurality of axially extending reinforcing ribs spaced around an outer circumference of said cylindrical intermediate portion.

5. The submersible electric motor driven pump according to claim 1, wherein said drive coupling comprises a hollow, cylindrical member having one end fixed to said motor shaft and having the other end slidably engaged with said pump shaft.

6. The submersible electric motor driven pump according to claim 1, wherein said motor assembly includes a gland at each end thereof, and said elongated tubular motor housing comprises a thin metal shell which is roll-formed into said gland at each end of said motor assembly.

7. The submersible electric motor driven pump according to claim 1, wherein said pump assembly further includes an inlet end cap disposed at a lower end of said elongated tubular pump housing, said inlet end cap having an inlet opening.

8. The submersible electric motor driven pump according to claim 7, wherein said inlet end cap includes a gland, said lower end of said elongated tubular pump housing being roll-formed into said gland.

9. The submersible electric motor driven pump according to claim 8, further comprising an O-ring seal disposed adjacent to said gland and located between said elongated tubular pump housing and said inlet end cap.

10. The submersible electric motor driven pump according to claim 2, wherein said pump-facing flange of said interface includes a gland, and said elongated tubular pump housing comprises a thin metal shell which is roll-formed into said gland.

11. The submersible electric motor driven pump according to claim 10, further comprising an O-ring seal disposed adjacent to said gland and located between said elongated tubular pump housing and said pump-facing flange.

12. The submersible electric motor driven pump according to claim 1, wherein said drive coupling comprises a cylindrical member having two separate shaft-receiving bores for respectively receiving the input end of said pump shaft and the output end of said motor shaft.

13. The submersible electric motor driven pump according to claim 1, wherein said pump assembly further comprises an intermediate shaft stabilizer for dampening shaft vibration.

14. The submersible electric motor driven pump according to claim 1, wherein said at least one impeller is formed from CELCON.

15. The submersible electric motor driven pump according to claim 1, further comprising a plurality of impellers.

16. The submersible electric motor driven pump according to claim 1, wherein said motor assembly further includes an annular chamber located between said electric motor and said elongated tubular motor housing for passing a major portion of a pumped liquid.

17. The submersible electric motor driven pump according to claim 1, wherein said motor assembly further includes a bypass passage, and said electric motor includes a stationary stator and a rotor fixed to said motor shaft, whereby a remaining portion of the pumped liquid passes between said rotor and said stator, through said bypass passage and back into a source of the pumped liquid.

18. A liquid petroleum gas submersible electric motor driven pump comprising:

a motor assembly including an elongated cylindrical motor housing, an electric motor disposed in said motor housing, and a rotary motor shaft having an output end which extends from said electric motor;

a pump assembly including an elongated cylindrical pump housing, a driven pump shaft having external spline teeth at an input end thereof, and at least one centrifugal impeller disposed on said pump shaft;

a drive coupling fixed by a fixing member to the output end of said motor shaft and having internal spline teeth which are slidably engaged with said external spline teeth of said pump shaft and for transmitting rotational power from said electric motor to said pump shaft, the end of said pump shaft being operative to float axially within said drive coupling; and a flanged interface surrounding said drive coupling and which rigidly joins said motor assembly and said pump assembly together coaxially end to end in a sealed manner.

* * * * *